United States Patent [19]

Fuss

[11] Patent Number: 4,838,591

[45] Date of Patent: Jun. 13, 1989

[54] ELECTRIC DOOR OPENER

[75] Inventor: Fritz H. Fuss, Albstadt, Fed. Rep. of Germany

[73] Assignee: Fritz Fuss KG, Albstadt, Fed. Rep. of Germany

[21] Appl. No.: 196,828

[22] Filed: May 20, 1988

Related U.S. Application Data

[63] Continuation of Ser. No. 858,926, May 2, 1986, abandoned.

[51] Int. Cl.[4] ..... E05C 21/02

[52] U.S. Cl. ..... 292/341.16

[58] Field of Search ..... 292/144, 201, 210, 254, 292/341.16

[56] References Cited

U.S. PATENT DOCUMENTS

| | | | |
|---|---|---|---|
| 352,154 | 11/1886 | Rousseau | 292/341.16 |
| 886,827 | 5/1908 | Loch | 292/341.16 |
| 1,471,455 | 10/1923 | Ernst | 292/341.16 |
| 1,618,738 | 2/1927 | Weiss | 292/341.16 |
| 3,543,547 | 12/1970 | Sugiyama | 292/341.16 X |
| 3,804,442 | 4/1974 | Powers | 292/341.16 |
| 3,819,215 | 6/1974 | Fuss | 292/341.16 X |
| 3,910,617 | 10/1975 | Scalza et al. | 292/341.16 |
| 4,015,869 | 4/1977 | Horvath | 292/341.16 |
| 4,211,443 | 7/1980 | Butts et al. | 292/341.16 |
| 4,471,983 | 9/1984 | Bischoff et al. | 292/341.16 |

FOREIGN PATENT DOCUMENTS

| | | | |
|---|---|---|---|
| 35085 | 7/1885 | Fed. Rep. of Germany | 292/341.16 |
| 72501 | 12/1893 | Fed. Rep. of Germany | 292/341.16 |
| 1026193 | 3/1958 | Fed. Rep. of Germany | 292/341.16 |
| 376227 | 8/1907 | France | 292/341.16 |
| 313939 | 7/1956 | Switzerland | 292/341.16 |

OTHER PUBLICATIONS

"Electrical Locking Devices" by Rofu Int'l Corp, May 1983; p. 3.

*Primary Examiner*—Richard E. Moore

*Attorney, Agent, or Firm*—Fleit, Jacobson, Cohn & Price

[57] ABSTRACT

An electric door opener is described, which is housed in a narrow, longitudinally symmetrical T-shaped casing. Behind a swing catch is arranged a changer constructed as a swing arm, which is approximately parallel to the swing catch axis and whose free end engages with the swing catch. A bolt operable by an electromagnet acts on the free end. The electromagnet coil is positioned parallel to the changer behind the swing catch.

2 Claims, 2 Drawing Sheets

ELECTRIC DOOR OPENER

Figure 1:
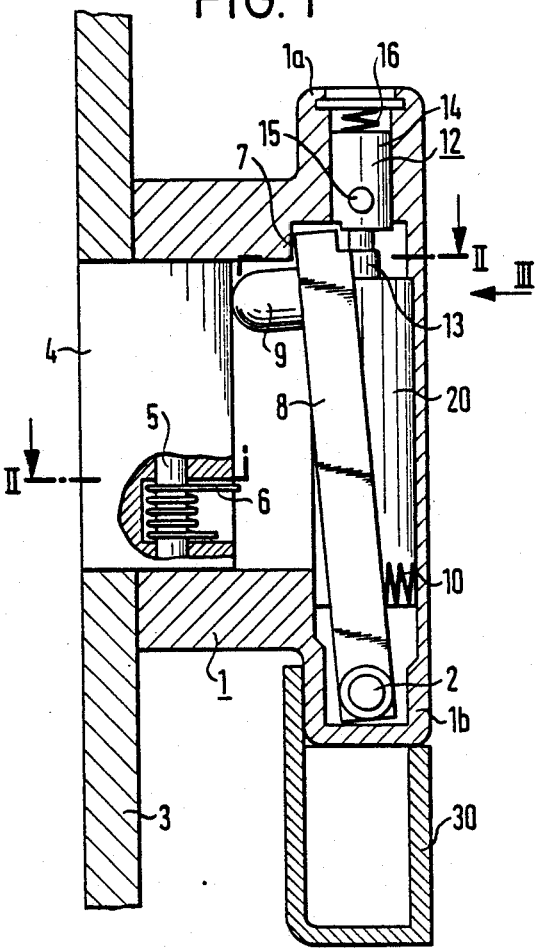

This application is a continuation application under 37 C.F.R. 1.62 of prior application Ser. No. 858,926, filed on May 2, 1986, entitled ELECTRIC DOOR OPENER, now abandoned.

The present invention relates to an electric door opener with a spring-loaded swing catch, with a changer for locking or releasing the swing catch and with an electromagnet for controlling the changer.

As is known, such a door opener is fitted into the frame of a door in such a way that the swing catch cooperates with a bolt or latch, which is fixed to the door. In the closed state, the swing catch engages behind the bolt and is held by the changer in this state until the catch is raised with the aid of the electromagnet. This swing catch can then be displaced or deflected counter to the tension of a spring, so that the bolt is released.

It is frequently impossible to use electric door openers in the case of narrow door frames, because the external dimensions of the known door openers are too large and the limited space on such frames does not permit the fitting thereof.

The problem of the present invention is to provide an electric door opener of the aforementioned type, which has small external dimensions.

This problem is solved in that the changer is constructed as a swing arm, which is aligned roughly parallel to the swing catch axis and is positioned behind said swing catch and that the free end of the swing arm engages with a spring-loaded bolt, which is subject to the action of the electromagnet.

Since in this arrangement all the parts essential for the function of the door opener are located behind the swing catch, the door opener can be made very narrow. Its fitting width is merely determined by the width of the bolt and the wall thickness of the casing. Thus, it is suitable for fitting in a narrow door frame. It is also possible to juxtapose two such door openers giving the possibility of locking doors with several bolts. Through the arrangement of the bolt and the bolt guide in the extension of the changer, a relatively limited fitting depth of the door opener is achieved.

According to a preferred further development of the invention, the bolt is constructed as a pin, which is displaceable parallel to the swing catch axis and is engaged with the changer by a stop or bolt spring. This construction has the advantage that the bolt and the guide can be manufactured in a simple manner, e.g. through using a cylinder bolt and a corresponding cylinder bore. This further development also has the advantage that the changer is locked when the electromagnet is not energized. It is therefore particularly suitable for an operating current door opener.

Alternatively thereto, it can be particularly advantageous for use with a holding current door opener to construct the bolt as a two-armed lever, whereof one arm is associated with the changer and whereof the other arm is associated with the electromagnet, whereby the bolt is disengaged from the changer in its inoperative position.

If the bolt is constructed as a pin, the latter is connected to the electromagnet armature by a laterally positioned stud. This measure makes it possible to displace the electromagnet and pin.

A particularly advantageous construction comprises the base and spindle of the changer being housed in one arm of a T-shaped casing, the bolt arrangement being located in the other arm, the electromagnet and the remainder of the changer being arranged in the part of the T-shaped casing connecting the two arms and the swing catch being positioned in the base portion of the T-shaped casing.

This further development has the advantage that the casing of the electric door opener can be constructed completely symmetrically in the longitudinal direction. Thus, the door opener can be incorporated into frames for both left-opening and right-opening doors, without it being necessary to provide different recesses in the door frame. The invention can preferably be further developed in such a way that there is an answer-back device with a sensor means for a door bolt. This has the advantage that it is possible to monitor whether the door fitted with the electric door opener is in the closed or open state.

The answer-back device preferably comprises the sensor being constituted by an auxiliary catch, which is connected to a microswitch via a trip lever. The auxiliary catch establishes whether a bolt is connected to the auxiliary catch. If this is the case, the auxiliary catch is deflected or displaced and the microswitch operated.

A preferred further development of the trip lever comprises positioning it parallel to the changer, constructing the same in two-armed manner, connecting one arm to the auxiliary catch and the other arm to the microswitch and arranging the trip lever and changer on a common axis.

It is advantageous for the trip lever and changer to be resiliently interconnected. Thus, the auxiliary catch and trip lever can be displaced independently of the swing catch and swing arm, whilst ensuring that the lever arm performs the swinging movement during a displacement of the swing arm, so as to free the swinging range of the swing catch.

It is particularly advantageous for the trip lever arm associated with the microswitch to be guided via a casing opening in a further casing and for the latter to contain the microswitch. This has the advantage that the door opener can be equipped at random with the trip lever and can be supplemented by the further casing with the microswitch.

The auxiliary catch preferably comprises an independently swingable, spring-loaded, circular segmental body within a laminated recess of the swing catch. This has the advantage that it can be arranged in space-saving manner in the door opener.

The invention is described in greater detail hereinafter relative to an embodiment and the attached drawings, wherein show:

FIG. 1, diagrammatically a side view of an electric door opener, one casing wall being removed.

Figure 2:
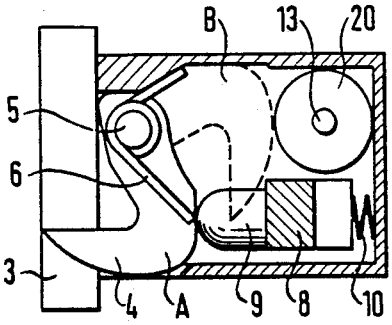

FIG. 2, diagrammatically a cross-section through the door opener according to FIG. 1.

Figure 3:
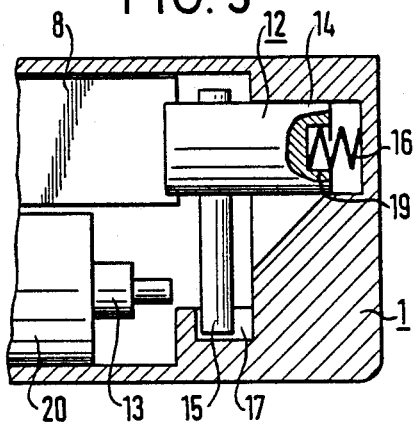

FIG. 3, in longitudinal section a detail of the door opener according to FIGS. 1 and 2.

Figure 4:
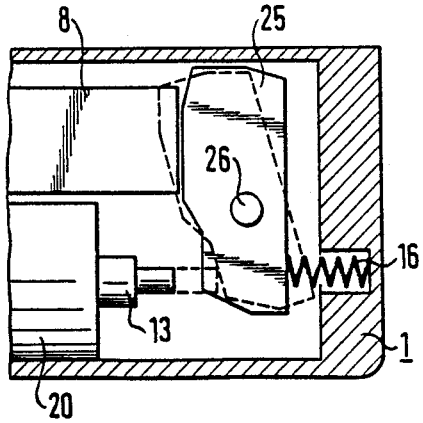

FIG. 4, an alternative to the detail of FIG. 3.

Figure 5:
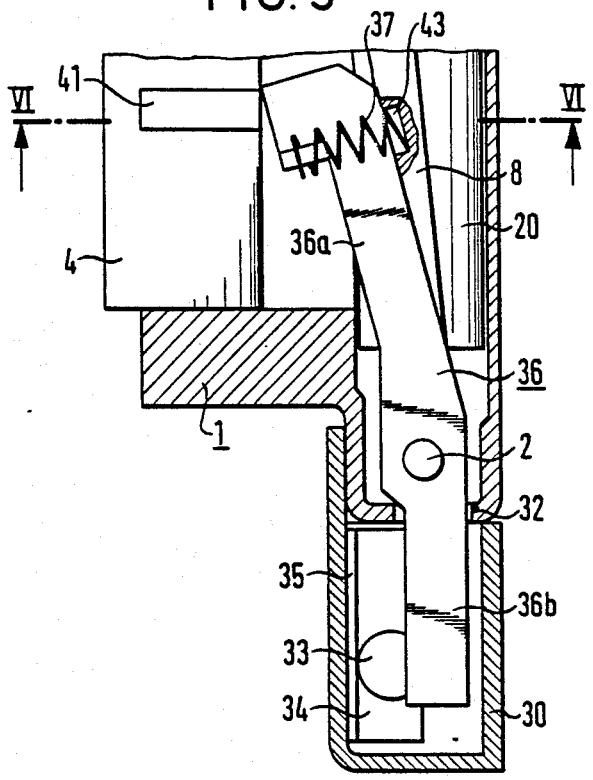

FIG. 5, diagrammatically a device for sensing swing catch on a door opener according to FIG. 1.

Figure 6:
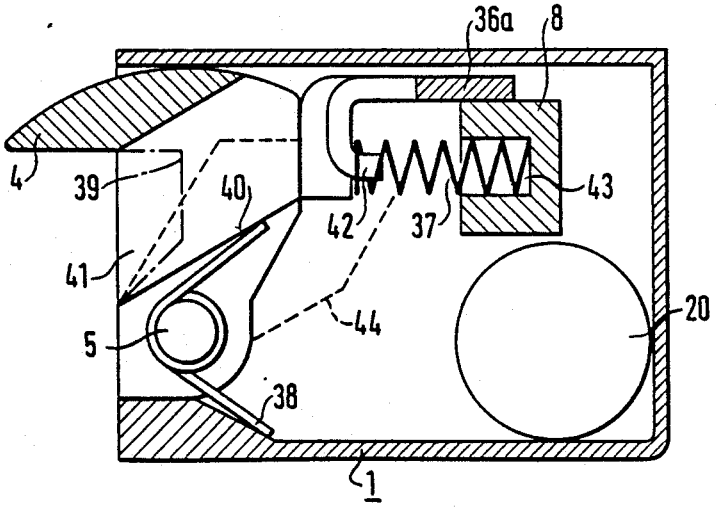

FIG. 6, a cross-section through the device according to FIG. 5.

FIG. 1 diagrammatically shows the electric door opener in side view, the casing 1 being opened by removing a side wall. The electric door opener is screwed onto a door frame 3 by its front narrow side. In the closed state, a door leaf would extend to the left alongside door frame 3 in the drawing plane. The door opener has a swing catch 4, which is pivotably mounted in casing 1 about a spindle 5. The swing catch 4 is prestressed against casing 1 by a spring clip wound around spindle 5 and held in the inoperative position shown in FIG. 1. In the swinging direction behind swing catch 4 is positioned a changer 8 constructed as a swing arm and which engages with the swing catch 4 via a clamping bolt 9. In the inoperative position, it engages on a stop shoulder 7 under the tension of a compression spring 10 supported on casing 1. Changer 8 is articulated to casing 1 by means of a pin 2. At its free end, changer 8 is in engagement with a bolt 12, which is subject to the action of an electromagnet armature 13, the magnet coil being designated 20. The bolt 12 comprises a locking pin 14, a bracing pin 15 and a stop spring 16.

The further casing is designated 30 and is screwed to casing 1. Its function will be described in detail in conjunction with FIGS. 5 and 6. Arrows II and III indicate the cross-sections shown in FIGS. 2 and 3. FIG. 6 clearly shows that the door opener, whilst ignoring the further casing 30 which can be optionally fitted, has a longitudinally symmetrical T-shaped casing 1. A bolt 12 is arranged in T-arm 1*a*. The other T-arm 1*b* contains the base and pivot pin 2 of changer 8, which is essentially parallel to spindle 5 and extends up to the shoulder of the opposite T-arm 1*a*.

The cross-section according to FIG. 2 illustrates the closed position A of swing catch 4, as well as an open position B, in which catch 4 has been swung roughly 90° rearwards. During this swinging movement, changer 8 is deflected counter to the tension of compression spring 10, clamping bolt 9 sliding along the rounded outside of the swing catch 4. FIG. 2 gives the position of the changer 8 in the closed position A of swing catch 4, in which it is secured by the spring clip 6.

For understanding the drawings, it is pointed out that the same parts always carry the same reference numerals.

FIG. 3 illustrates the way in which the changer 8 is locked and unlocked. In the represented embodiment showing the arrangement in arrow direction III according to FIG. 1, the bolt 12 comprises a cylindrical locking pin 14, which is displaceable on a cylindrical recess in casing 1 parallel to the spindle 5 of swing catch 4. A bracing pin 15 is fitted to locking pin 14 and runs at right angles to the movement direction of pin 14 and is guided in a bracing pin guide slot 17 over the end face of armature 13. If the coil 20 is energized or excited, armature 13 hammers on bracing pin 15 and moves it back together with the locking pin 14 counter to the spring tension of a stop spring 16. This removes the engagement with changer 8, which can consequently be swung out of the drawing plane. In order to show the arrangement of the stop spring 16 in a recess 19 of locking pin 14, the latter is cut open at the relevant point. The function of the electric door opener will now be described relative to FIGS. 1 to 3. If coil 20 is not energized, armature 13 is in the inoperative position, when no action on bracing pin 15 takes place. Thus, the stop spring 16 can move the locking pin 14 behind the free end of changer 8, which pressed by compression spring 10 against the swing catch 4 when the latter is in the closed position A. However, this takes place independently through the spring clip 6. The locking of changer 8 also locks the swing catch 4.

When power is supplied, armature 13 hammers against the bracing pin 15, so that locking pin 14 releases changer 8. Thus, the swing catch 4 can be swung and the door opened. An electric door opener functioning in this way can be called an operating current opener.

A so-called holding current opener, as is shown in FIG. 4, releases the swing catch 4 when coil 20 is not energized. The swing catch 4 is only locked if a permanent current is supplied to coil 20. In the example of FIG. 4, bolt 12 is formed by a two-armed lever 25, which is pivotably mounted by means of a spindle 26. One arm of the bolt lever 25 is associated with changer 8 and the other arm is associated with armature 13. Bolt lever 25 is pretensioned by stop spring 16 in such a way that it frees the path of changer 8 when the electromagnet is in the inoperative position. If coil 20 is energized, the bolt lever is displaced by armature 13, moves behind changer 8 and locks the latter. This state is indicated by the broken line in FIG. 4. FIG. 5 shows a further development of the electric door opener, as shown in FIG. 1. In particular details are illustrated in the base region of changer 8 and the further casing 30. FIG. 6 illustrates a cross-section through the door opener in arrow direction VI. The drawings essentially show a means, with which it is possible to establish the closed state of the door bolt and which can e.g. be indicated back to a monitoring station. According to FIGS. 5 and 6, a sensor is arranged in the bolt reception zone of the swing catch 4 and in the present case it is realized in the form of an auxiliary catch 41. Auxiliary catch 41 is constructed as a circular segmental body and is arranged in the swing catch 4 within a laminated recess. FIG. 6 illustrates that the auxiliary catch 41 can be swung rearwards on spindle 5 in the same way as swing catch 4 and is pretensioned counter to the swinging direction by a further lever spring 38, which is supported on casing 1 and on a shoulder 40 of auxiliary catch 41. Thus, auxiliary catch 41 can be deflected independently of the swing catch 4.

The sensor function of auxiliary catch 41 is based on the fact that it extends into the hook recess of the catch 41 and which is indicated in FIG. 6 by a dot-dash line 39. Thus, if a door bolt passes into the hook recess of the swing catch 4, it comes into contact with auxiliary catch 41 and deflects it rearwards counter to the tension of the further lever spring 38. This position of auxiliary catch 41 is shown by a broken line 44. The lever spring 38 is supported on a shoulder 40 on the side of auxiliary catch 41.

A two-armed trip lever 36 engages by its one arm 36*a* with the back of auxiliary catch 41. Via an opening 32 in casing 1, its other arm 36*b* passes into the further casing 30, where it engages with a control button 33 of a microswitch 34.

If the trip lever 36 is displaced clockwise by the auxiliary catch 41 in accordance with FIG. 5, control button 33 is pressed in the drawing plane in the direction of the microswitch 34 on the underside of arm 36*b* of control button 33, so that microswitch 34 is actuated. If the trip lever 36 is returned to its initial position, there is a corresponding change to the operating state of microswitch 34. The output signal of microswitch 34 can be used for monitoring the state in which a door bolt is in corresponding engagement with the swing catch 4.

Tip lever 36 and changer 8 are spring-loaded with respect to one another. In the represented example, this connection is realized by a compression spring 37, which on the side of the changer 8 is received by a cylindrical recess 43. On the side of the trip lever 36, the compression spring 37 is supported on an angle piece 42, which is shaped onto the free end of arm 36*a*.

The supporting of compression spring 37 on changer 8 ensures an independent deflection of the lever switch 36 from changer 8. However, arm 36*a* is displaced rearwards together with changer 8 and frees the path for the swing catch 4 if the latter is swung rearwards.

As can be clearly gathered from FIG. 6, compared with changer 8, lever switch 36 is relatively narrow, so that it can be positioned between changer 8 and the casing wall. Angle piece 42 engages behind the changer 8 and ensures contact with the auxiliary catch 41 over the entire swinging range.

I claim:

1. An electric door opener comprising a symmetrical T-shaped casing including a base portion and a cross-bar portion perpendicular to the base portion, the cross-bar portion having first and second T-arms, and a central part connecting the two T-arms;

a swing catch pivotally mounted on a spindle in the base portion of the casing;

a changer pivotally mounted on a pin perpendicular to the spindle and having a base and a free end;

the base being arranged in the first T-arm, the free end engaging with the swing catch and extending to the second T-arm;

an electromagnet including a coil and an armature slidingly arranged coaxial with the coil and having an end face;

the electromagnet being arranged in the central part of the casing connecting the two T-arms and parallel to the spindle with the end face of the armature extending to the second T-arm;

a spring loaded sliding bolt including means engaging with and disengaging from the free end of the changer;

a recess in the second T-arm for housing the sliding bolt;

the sliding bolt having a longitudinal axis along which it slides and which is parallel to the spindle;

the end face of the armature being disposed for hammering against the sliding bolt when the electromagnet is energized;

the sliding bolt being in a locking position with respect to the changer when the electromagnet is not energized and being in a releasing position with respect to the changer when the electromagnet is energized.

2. Electric door opener according to claim 1, wherein said sliding bolt comprises a laterally projecting bracing pin positioned over an end face of the armature.

* * * * *